United States Patent [19]

Scaglia

[11] 4,007,888

[45] Feb. 15, 1977

[54] YARN BOBBIN AND METHOD FOR MANUFACTURING THE SAME

[75] Inventor: Enzo Scaglia, Brembilla (Bergamo), Italy

[73] Assignee: M. Scaglia S.p.A., Milan, Italy

[22] Filed: July 14, 1975

[21] Appl. No.: 595,422

[52] U.S. Cl. ..... 242/118.6; 29/428; 242/118.8

[51] Int. Cl.[2] ..... B65H 75/14

[58] Field of Search ..... 242/118.6, 118.61, 118.62, 242/118.8, 118.4, 115, 77.4; 29/428

[56] References Cited

UNITED STATES PATENTS

| | | | |
|---|---|---|---|
| 414,474 | 11/1889 | Adt | 242/118.62 |
| 1,822,474 | 9/1931 | Bureau | 242/77.4 |
| 2,083,337 | 6/1937 | Mack | 242/118.61 |
| 2,264,117 | 11/1941 | Howsam | 242/118.6 |
| 2,583,995 | 1/1952 | Burlein | 242/118.62 |
| 3,317,160 | 5/1967 | Laird | 242/118.62 |

*Primary Examiner*—George F. Mautz
*Attorney, Agent, or Firm*—Wenderoth, Lind & Ponack

[57] ABSTRACT

A yarn bobbin and a method for manufacturing the same, wherein the yarn bobbin includes a tubular hollow core with beads fitted or formed at both ends thereof, and which cooperate with core inserts to house, center and removably secure bobbin flanges. Preferably, the beads are formed by inwardly curling the ends of the metallic core, and the flanges are secured by screws engaging with threaded holes formed through the beads and at least in partially into the core inserts.

4 Claims, 4 Drawing Figures

YARN BOBBIN AND METHOD FOR MANUFACTURING THE SAME

BACKGROUND OF THE INVENTION

1. Field of the Invention

This invention relates to a novel and improved method for manufacturing a yarn bobbin, as well as to a bobbin obtained by such method.

More specifically, this invention relates to a method for manufacturing yarn bobbins particularly suitable for winding high count yarns, and essentially formed by a cylindrical hollow core having flanges removably fastened to opposite ends thereof.

2. Description of Prior Art

To removably secure the flanges to a bobbin core is an already well known technique, particularly suitable when high count yarns are to be wound thereon, i.e. when no danger exists that the yarn may get engaged or "pinched" between the core ends and the flanges during reciprocating motions of related opposite surfaces, due to different stresses that are exerted on the flanges by the wound yarn in an axial outward direction, when the bobbin is relatively full and relatively empty. Obviously, when using high count yarns, a given relative motion of the opposite surfaces is allowed, provided that an opening wider than the yarn size is not formed between the mating surfaces under the highest possible stress.

The removably fitted flanges, which are usually secured by means of screws to front sides, of the core, have the advantage of allowing for a quick and easy replacement thereof in case of breakage.

However, heretofore a heavy drawback is shown by heretofore known bobbins having removable flanges have the disadvantage, due to the fact that they require a thick walled core, or at least thicker ribs extending in a radial direction with respect to the core axis, to allow for drilling threaded holes on the front sides of the core, as required to accomodate screws for securing the flanges. This results in a substantial waste of material, since the end portion only of the ribs is utilized, as well as in undue increases of core weight and moment of inertia, not always accurately balanced with respect to the core axis, and accordingly requires a more difficult balancing operation of the core and the entire bobbin.

SUMMARY OF THE INVENTION

Accordingly, an object of this invention is to provide a method for manufacturing a yarn bobbin of the type set forth above, i.e. with flanges removably fastened to the core, that makes it possible to obtain a bobbin meeting all operating requirements and adapted to be produced relatively inexpensively, above all due to a decrease in the amount of material required for the core.

According to this invention, the method comprises the steps of providing a tubular shaped core member; fitting into opposite ends of the core member inserts designed to allow the bobbin to be mounted on a winding machine, the assembling and centering of flanges and/or the balancing of the core; forming or fitting a substantially annular inner bead at opposite ends of core member into a recess or seat provided on the outer sides of the respective inserts; forming retaining means — e.g. threaded holes—through the beads; and fastening the flanges at the core member ends by means of locking elements acting in cooperation with the retaining means. The beads, at opposite ends of the tubular core member, allow both the drilling of threaded holes for fastening the flanges and simultaneously the locking of the inserts in their positions, as well as the formation of supporting and centering surfaces for the flanges. The beads may be in the form of separate structural members fitted into the bobbin core and secured thereto, or they may be integrally formed by mechanically inwardly bending opposite ends of the core, in the form of curl-shaped beads. The outer sides of the curls can then be suitably machined to form for forming said flange supporting and centering surfaces. This latter embodiment is particularly suitable when employing metal cores, e.g. aluminium cores, whereby the curl-shaped beads can be formed by rolling or the like.

As previously stated, the invention is also directed to a yarn bobbin of the removable flange type, as obtained by carrying-out the previously stated method and essentially characterized in that two beads are fitted to or integrally formed on opposite ends of a tubular core, in order to accomodate flange fastening means, to retain the core end inserts and to form flange supporting and centering surfaces.

DESCRIPTION OF THE PREFERRED EMBODIMENT

Figure 1:
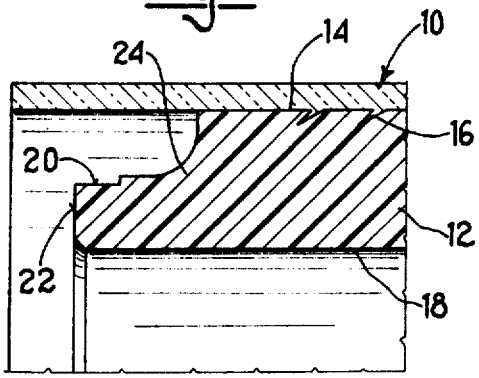
FIGS. 1 to 4 are partly sectional views, taken on the axis of a bobbin core and showing different, successive bobbin manufacturing steps.

Referring now to the drawings, the manufacturing steps for obtaining a yarn bobbin of the removable flange type, are shown with reference to the operations that are performed on one bobbin end only, but of course it is to be understood that the same operations are parallelly carried-out on the opposite bobbin end. According to the invention, a tubular core member 10 is provided, having a wall thickness that is sufficient, depending on the material of the core, to cope with the stresses occurring as the yarn is wound thereon. As shown in FIG. 1, a suitable insert 12, e.g. of plastics, is fitted inside each of the ends of the tubular core member 10. The axial length of inserts 12 is rather small and the diameter thereof is sized to allow the inserts to be force fitted into the core interior. The outer cylindric surface 14 of insert 12 is formed with small notches 16, to positively avoid a further shifting of insert 12 into the core interior.

Each insert 12 has comprises, in an already known manner: a coaxially extending hole 18, having an inner diameter suitable for supporting the bobbin on a winding machine, a reduced outer diameter a cylindrical surface 20 adapted to be coupled to a flange seat for fastening and centering a flange on the related core end, and a substantially annular end surface 22, extending between the hole 18 and surface 20, and wherein means for statically and/or dynamically balancing the core may be fitted. Additionally, between the surfaces 20 and 14 of each insert 12, a further suitably shaped surface 24 is provided, forming a seat wherein a bead applied to or formed at the corresponding core end can be housed.

Obviously, as will be more clearly described below, the inserts 12 are introduced into the core 10 and forced toward the middle portion thereof for a given length, depending on the manner in which all other method steps will be carried-out, but in all cases substantially in such a manner that a bead to be formed by the end of the core will be at least approximately accomodated in the seat 24, while the surface 20 should axially project out of the end of the finished tubular core 10.

Figure 2:
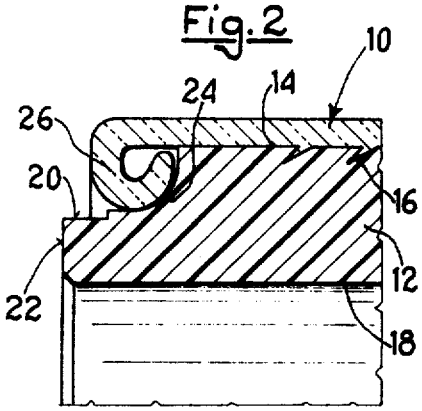

The next bobbin manufacturing step comprises a fitting or forming operation of a substantially annular bead between the free ends of core member 10 and each respective insert 12. In FIG. 2 such bead is formed by mechanically rolling the ends of core member 10, which in the considered case is made of a metal material, e.g. aluminium. By such operation, a bead 26 having a curled cross sectional shape is formed and is substantially housed within the seat 24 of insert 12.

Figure 3:
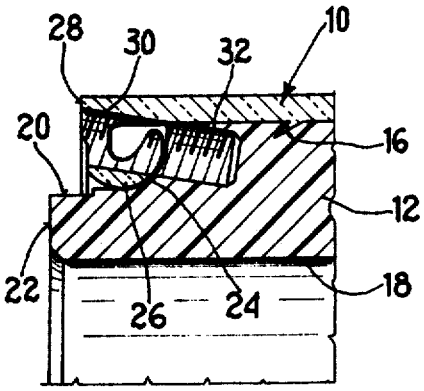

FIG. 3 shows that bead 26 has been mechanically flattened, in order to form a surface 28 perpendicular to the core axis which is designed to support and center a related flange. Such operation could be left-out when the bead is in the form of a separate structural member which is then applied to the core, since the required supporting and centering surface may be formed by the front edges of the tubular core member and/or by the separately applied bead. In any case, a suitable number of threaded holes 30 are drilled through the bead 26, at suitable angular spacings, for the application of flange fastening screws. Such threaded holes (e.g. four threaded holes) may extend in a direction slightly inclined from the outside toward the core axis and could advantageously extend at least partially into the respective inserts 12.

Figure 4:
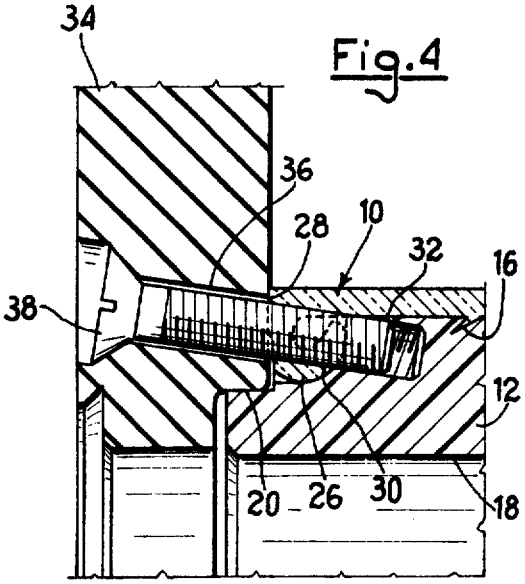

Finally, as shown in FIG. 4, suitable flanges 34 of an already known type are fastened to the thus prepared core, in a position wherein the flanges are supported and centered on the bead surface 28, as well as on the surface 20 of insert 12. Formed in flanges 34 are holes 36, through which screws 38 are inserted and screwed into the threaded holes 30, in order to secure the flanges in their operating position and simultaneously to retain the inserts 12 by means of a portion 32 of the holes extending into the inserts.

The previously described and illustrated embodiment is to be considered as a non-restrictive example only, since many changes may be made therein without departing from the spirit and scope of the invention, as may be readily appreciated by those skilled in the art. Thus, e.g. the flanges may be fastened by means different than the described ones, e.g. by plugs engaged therewith and having threaded or suitably shaped portions, designed to cooperate with mating portions formed on the bead inner diameter, e.g. by screw, bayonet or like connections.

I claim:

1. A method for manufacturing a yarn bobbin having a metal cylindrical core with flanges removably secured to opposite ends thereof, said method comprising:

providing a tubular metallic core member;

force fitting into each opposite end of said core member a centrally bored plastic insert having at the outer end thereof a radially outwardly facing annular recess and a reduced outer diameter cylindrical stepped surface;

deforming each said opposite end of said core member to form an annular bead seated in the respective said annular recess, said step of deforming comprising bending said core member inwardly and rearwardly in the shape of a spirally-coiled curl;

forming threaded holes in radially inwardly inclined directions through each said bead and at least partially through the respective said insert;

positioning and centering flanges around each said stepped surface and abutting the respective said flange against the end of the respective said bead; and securing said flanges to said core member and the respective said inserts by threading screws extending through said flanges into said threaded holes.

2. A method as claimed in claim 1, further comprising machining the end surface of each said bead to form abutting surfaces extending transverse to the longitudinal axis of said core member.

3. A yarn bobbin comprising:

a tubular metallic core member having opposite end portions;

a pair of centrally bored plastic inserts, one each force fitted into opposite ends of said core member, each said insert having at the outer end thereof a radially outwardly facing annular recess and a reduced outer diameter cylindrical stepped surface;

each said end portion of said core member being deformed inwardly and rearwardly in the form of a spirally-coiled curl-shaped bead seated in a respective said recess;

radially inwardly inclined threaded holes extending through each said bead and at least partially through the respective said insert;

a pair of flanges, each having a central bore positioned against and centered around a respective said stepped surface, each said flange abutting the end of a respective said bead; and thread means, extending through each said flange and the respective said holes, for securing said flanges to said core member and the respective said inserts.

4. A bobbin as claimed in claim 3, wherein the end surface of each said bead is a plane surface extending transverse to the longitudinal axis of said core member.

* * * * *